US006124704A

United States Patent [19]

Annema

[11] Patent Number: 6,124,704

[45] Date of Patent: Sep. 26, 2000

[54] REFERENCE VOLTAGE SOURCE WITH TEMPERATURE-COMPENSATED OUTPUT REFERENCE VOLTAGE

[75] Inventor: Anne J. Annema, Eindhoven, Netherlands

[73] Assignee: U.S. Philips Corporation, New York, N.Y.

[21] Appl. No.: 09/203,633

[22] Filed: Dec. 1, 1998

[30] Foreign Application Priority Data

Dec. 2, 1997 [EP] European Pat. Off. ..... 97203772

[51] Int. Cl.[7] ..... G05F 3/16

[52] U.S. Cl. ..... 323/313; 323/907

[58] Field of Search ..... 323/312, 313, 323/315, 907; 327/535, 538, 539; 330/257, 288

[56] References Cited

U.S. PATENT DOCUMENTS

| | | | |
|---|---|---|---|
| 4,443,753 | 4/1984 | Mcglinchey | 323/313 |
| 4,525,663 | 6/1985 | Henry | 323/313 |
| 4,968,905 | 11/1990 | Sanwo et al. | 323/907 |
| 5,373,226 | 12/1994 | Kimura | 323/313 |
| 5,488,289 | 1/1996 | Yeung | 323/312 |
| 5,684,393 | 11/1997 | Ryat | 323/312 |

*Primary Examiner*—Matthew Nguyen
*Attorney, Agent, or Firm*—Brian J. Weighaus

[57] ABSTRACT

A reference voltage source with linear temperature compensation for use in a band gap voltage reference circuit. The reference voltage source comprises a voltage follower comprising a differential pair. The voltage follower is arranged in cascade with a reference circuit for supplying a compensation voltage in series with a temperature dependent reference voltage of the reference circuit. The voltage follower delivers a temperature independent output voltage between the output of the voltage follower and a reference terminal.

10 Claims, 6 Drawing Sheets

REFERENCE VOLTAGE SOURCE WITH TEMPERATURE-COMPENSATED OUTPUT REFERENCE VOLTAGE

BACKGROUND OF THE INVENTION

The invention relates to a reference voltage source for supplying a reference voltage.

In the general state of the art it is common practice to use a so-called band gap voltage reference circuit as a reference voltage source. The reference voltage is then determined by the sum of a diode voltage and a voltage across a resistor. The diode voltage has a negative temperature coefficient which is compensated by a positive temperature coefficient of the voltage across the resistor.

A disadvantage of conventional band gap voltage reference circuits is that they comprise resistors of comparatively large value, which resistors should be matched in value with each other. Particularly in IC processes, in which it is difficult or not possible to fabricate resistors which are accurate and have comparatively high resistance values, said disadvantage is a very significant factor. As a result, there is a need for band gap voltage reference circuits in which the positive temperature coefficient necessary for compensation of the negative temperature coefficient of the diode voltage is realized in another manner.

SUMMARY OF THE INVENTION

It is an object of the invention to provide a reference voltage source which mitigates the afore-mentioned disadvantages.

To this end, according to the invention, the reference voltage source of the type defined in the opening paragraph is characterized in that the reference voltage source further comprises at least one differential pair coupled to the reference voltage source to supply a compensation voltage in series with the reference voltage, in order to obtain a compensated output reference voltage. If the compensation voltage has an equal but opposite temperature coefficient, it is thus achieved that the output reference voltage, which is the sum of the reference voltage and the compensation voltage, is temperature independent.

A reference voltage source in accordance with the invention is further characterized in that the at least one differential pair comprises two transistors which have not been matched with one another. This means that the two transistors have different dimensions and/or a different current bias. As a consequence, the voltage between the control electrode of the one transistor and the tail of the at least one differential pair is unequal to the voltage between the control electrode of the other transistor and the tail, as a result of which a voltage difference prevails between the control electrode of the two transistors, which voltage difference forms the compensation voltage. Since the reference voltage generally exhibits a negative linear temperature dependence an optimum compensation is achieved when the compensation voltage exhibits an equal but positive linear temperature dependence. To this end, the two transistors of the differential pair should have an exponential voltage-current characteristic. Various types of transistors are suitable for this purpose, such as bipolar transistors, DTMOSTs (Dynamic Threshold MOSTs) and MOSTs operated in the so-called weak inversion region.

BRIEF DESCRIPTION OF THE DRAWING

The invention will now be described in more detail with reference to the accompanying drawings, in which.

In these Figures parts or elements having like functions or purposes bear the same reference symbols. The resistors shown in FIGS. 1 and 2 have values expressed in the same quantities as the resistors constructed as other components.

DETAILED DESCRIPTION OF THE PREFERRED EMBODIMENTS

Figure 1:
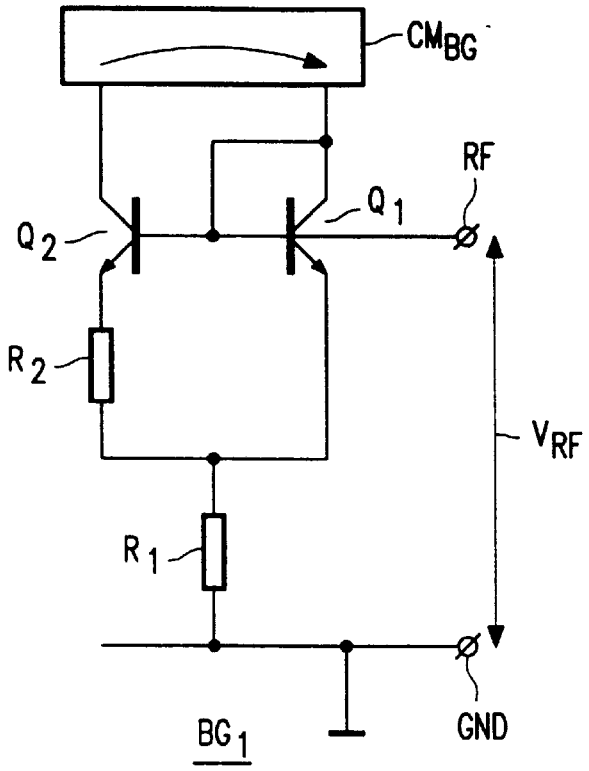
FIG. 1 shows an example of a conventional band gap voltage reference circuit.

FIG. 1 shows an example of a conventional band gap voltage reference circuit $BG_1$. The band gap voltage reference circuit $BG_1$ supplies a temperature-compensated output reference voltage $V_{RF}$ between an output reference voltage terminal RF and a power supply reference terminal GND. The band gap voltage reference circuit $BG_1$ comprises a first band gap transistor $Q_1$ connected as a diode by means of a base-collector short-circuit; a second band gap transistor $Q_2$ having its base connected to the base of the first band gap transistor $Q_1$; a first resistor $R_1$ connected between the emitter of the first band gap transistor $Q_1$ and the power supply reference terminal GND; a second resistor $R_2$ connected between the emitter of the second band gap transistor $Q_2$ and the emitter of the first band gap transistor $Q_1$; and a current mirror $CM_{BG}$ having an input and an output interconnected to the collector of the first band gap transistor $Q_1$ and the collector of the second band gap transistor $Q_2$, respectively. The output reference voltage $V_{RF}$ can be calculated by means of the formula [1]:

$$V_{RF}=V_{BE1}+(kT/q)*(R_1/R_2)*1n(M) \quad [1]$$

Herein:

$V_{BE1}$ is the base-emitter voltage of the first band gap transistor $Q_1$; k is Boltzmann's constant; T is the temperature in degrees Kelvin; q is the elementary charge; In is the natural logarithm; and M is the current density ratio between the first and the second band gap transistors $Q_1$, $Q_2$.

Figure 2:
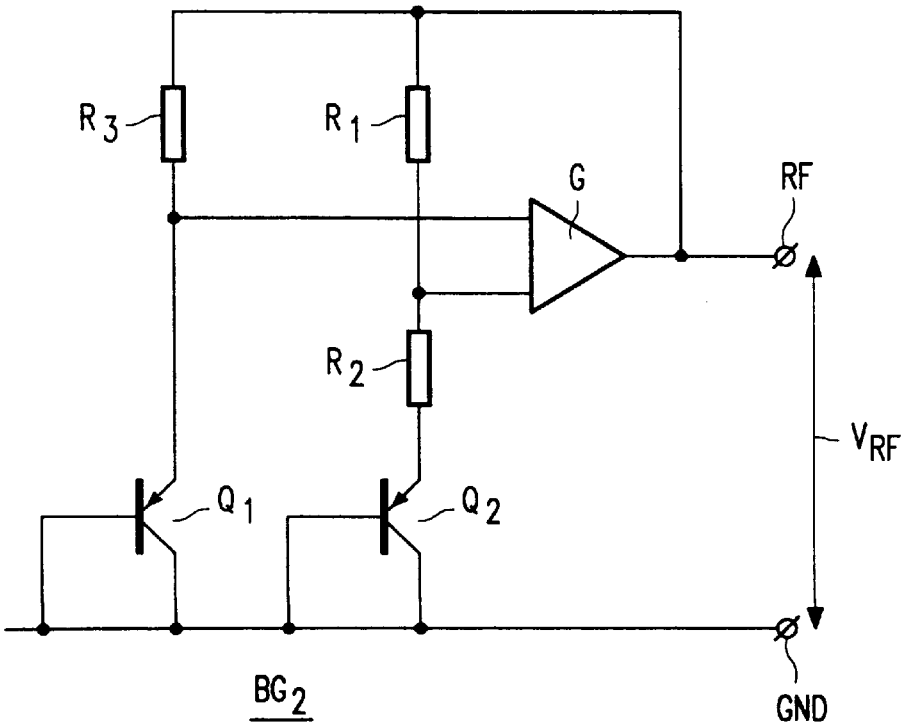
FIG. 2 shows another example of a conventional band gap voltage reference circuit.

FIG. 2 shows another example of a conventional band gap voltage reference circuit $BG_2$. In this circuit the diode-connected band gap transistor $Q_1$ has its collector and base connected to the power supply reference terminal GND and its emitter to a first input of an amplifier G. The first resistor $R_1$ is connected between a second input of the amplifier G and an output of the amplifier G. The second resistor $R_2$ is connected between the emitter of the band gap transistor $Q_2$ and the second input of the amplifier G. The band gap transistor $Q_2$ is also diode-connected in that it has both its collector and its base connected to the power supply reference terminal GND. The band gap voltage reference circuit $BG_2$ further comprises a third resistor $R_3$ connected between the emitter of the first band gap transistor $Q_1$ and the output of the amplifier G. If, as is customary, the value of the third resistor $R_3$ is equal to the value of the first resistor $R_1$, the output reference voltage $V_{RF}$ also complies with formula [1].

As is apparent from formula [1], the output reference voltage $V_{RF}$ in conventional band gap voltage reference circuits as shown in FIGS. 1 and 2 is dependent on the base-emitter voltage $V_{BE1}$. The base-emitter voltage $V_{BE1}$ has a negative linear temperature coefficient. The second term (to the right of the summation operator) has a positive linear temperature coefficient. The output reference voltage $V_{RF}$ is therefore only temperature independent for a given dimensioning of the current density ratio M and the quotient of the values of the first resistor $R_1$ and the second resistor $R_2$ in relation to one another. This dimensioning is given by the following formula [2]:

$$(R_1/R_2)*1n\ (M)=-(q/k)*C_{BE1} \quad [2]$$

in which $C_{BE1}$ is the negative linear temperature coefficient of the base-emitter voltage $V_{BE1}$.

Figure 3:
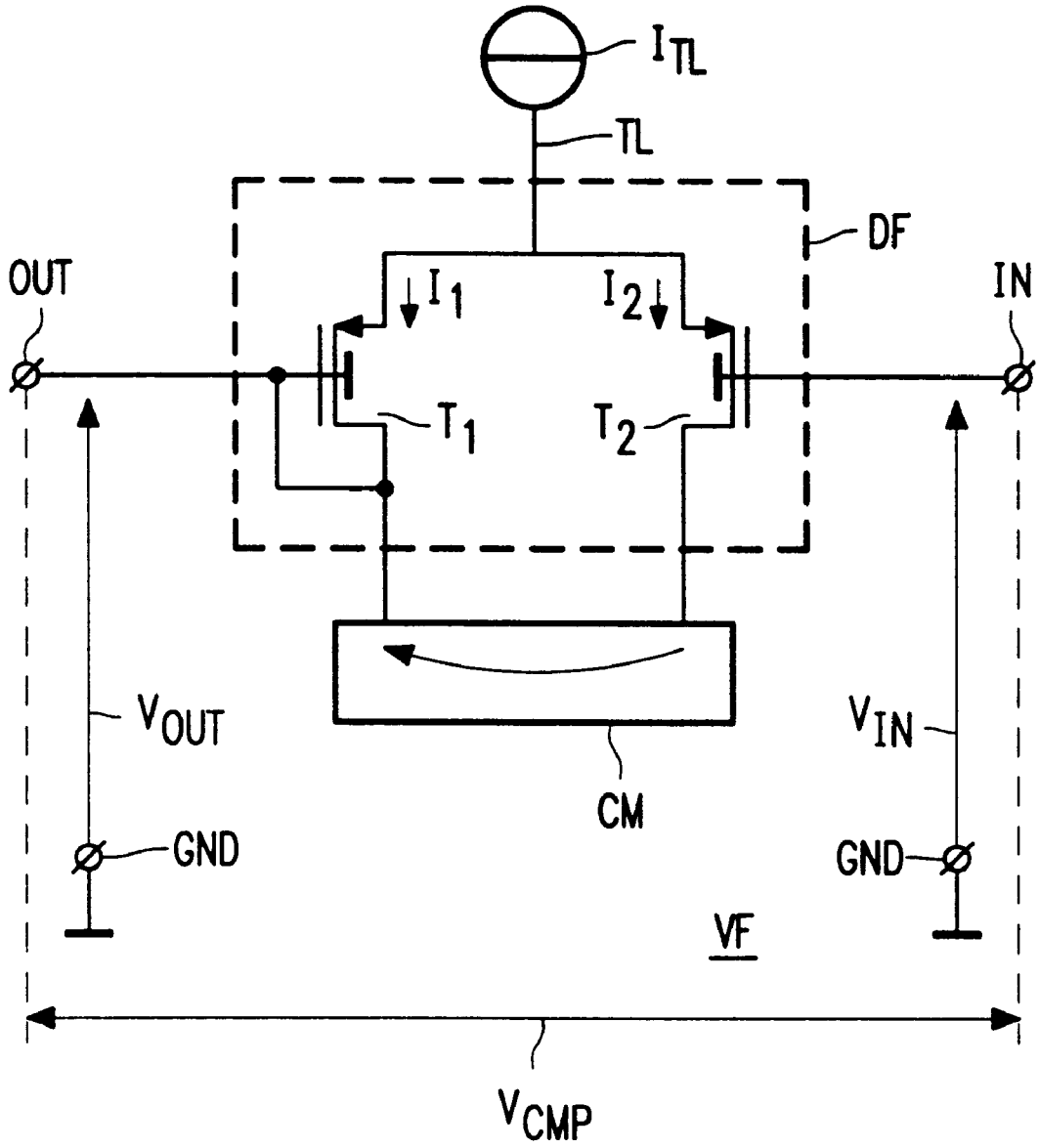
FIG. 3 shows an example of a voltage follower with a differential pair for use in a reference voltage source in accordance with the invention.

FIG. 3 shows an example of a voltage follower VF comprising a differential pair DF for use in a reference voltage source in accordance with the invention. The voltage follower VF further comprises a current mirror CM having an input and an output, a tail current source $I_{TL}$ for supplying a current to a tail TL of the differential pair DF. The differential pair DF comprises a diode-connected first transistor $T_1$ having a control electrode connected to an output OUT of the voltage follower VF, a first main electrode and a second main electrode; and a second transistor $T_2$ having a control electrode connected to an input IN of the voltage follower VF, a first main electrode and a second main electrode. The first main electrodes of the first transistor $T_1$ and the second transistor $T_2$ together form the tail TL of the differential pair DF. In response to an input voltage $V_{IN}$ applied between the input IN and the power supply reference terminal GND, an output voltage $V_{OUT}$ is produced between the output OUT and the power supply reference terminal GND. Since the current density ratio M between the first transistor $T_1$ and the second transistor $T_2$ is not equal to unity, the output voltage $V_{OUT}$ is not equal to the input voltage $V_{IN}$. A compensation voltage $V_{CMP}$ is defined by the formula [3]:

$$V_{CMP}=V_{IN}-V_{OUT} \quad [3]$$

Figure 4:
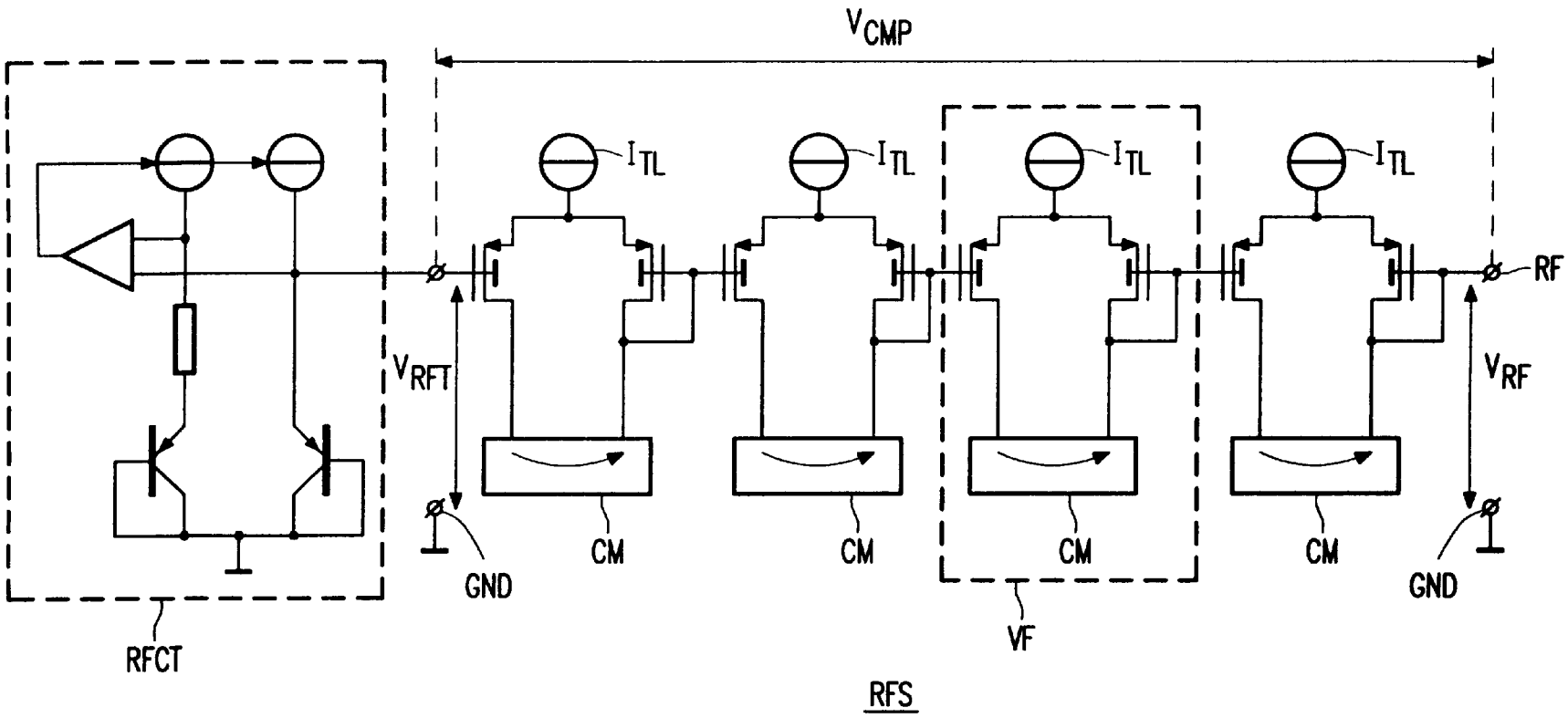
FIG. 4 shows a first embodiment of a reference voltage source in accordance with the invention.
Figure 5:
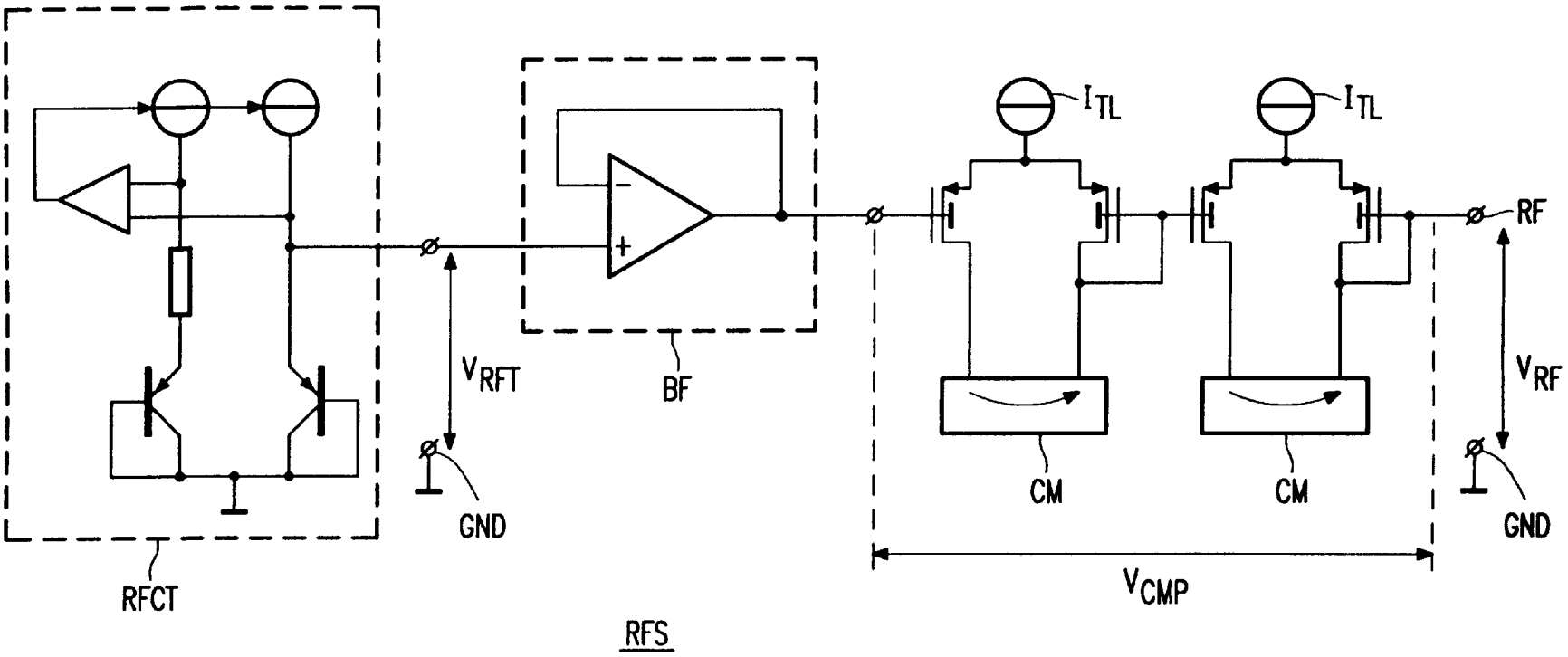
FIG. 5 shows a second embodiment of a reference voltage source in accordance with the invention.

If for the first transistor $T_1$ and the second transistor $T_2$ transistors are used which exhibit an exponential voltage-current characteristic the compensation voltage $V_{CMP}$ has a linear temperature coefficient. For this purpose, it is possible to use for the first transistor $T_1$ and the second transistor $T_2$, for example so-called DTMOSTs (Dynamic Threshold MOSTs) as shown in FIGS. 3, 4 and 5. The compensation voltage $V_{CMP}$ is then given by the formula [4]:

$$V_{CMP}=(kT/q)*1n\{(W_1/W_2)*(L_2/L_1)*(I_2/I_1)\} \quad [4]$$

Herein:

$W_1$ is the width of the first (DTMOST) transistor $T_1$;

$W_2$ is the width of the second (DTMOST) transistor $T_2$;

$L_1$ is the length of the first (DTMOST) transistor $T_1$;

$L_2$ is the length of the second (DTMOST) transistor $T_2$;

$I_1$ is the current through the first (DTMOST) transistor $T_1$;

$I_2$ is the current through the second (DTMOST) transistor $T_2$.

From formula [4] it is apparent that the compensation voltage $V_{CMP}$ has a linear temperature coefficient which is positive or negative depending on the dimensioning of the first transistor $T_1$ and the second transistor $T_2$. This implies that by means of the voltage follower VF it is possible to compensate for the negative linear temperature coefficient $C_{BE1}$ of the base emitter voltage $V_{BE1}$ of the first band gap transistor $Q_1$ of a conventional band gap voltage reference circuit as shown in FIGS. 1 and 2 if the formula [5] is complied with:

$$(W_1/W_2)*(L_2/L_1)*(I_2/I_1)=exp\{-(q/k)*C_{BE1}\} \quad [5]$$

From formula [5] it follows that, as opposed to the conventional methods (see formula [2]), no resistors are necessary to compensate for the negative linear temperature coefficient $C_{BE1}$.

FIG. 4 shows a first embodiment of a reference voltage source RFS in accordance with the invention. The reference voltage source RFS comprises a reference circuit RFCT which supplies a reference voltage $V_{RFT}$ having a linear negative temperature coefficient. In its simplest form the reference circuit comprises a diode which is energized with a current source, but alternatively other reference circuits know from the general state of the art can be used. A voltage follower VF is arranged in cascade with the reference circuit RFCT and converts the temperature dependent reference voltage $V_{RFT}$ into a temperature compensated output reference voltage $V_{RF}$. The dimensioning of the first transistor $T_1$ and the second transistor $T_2$ in relation to one another follows from formula [5]. In a practical situation it may occur that the dimensions of the first transistor $T_1$ and the second transistor $T_2$ in relation to one another are unfavorable, for example, the width of the first transistor $T_1$ should be 100,000 times as large as the width of the second transistor $T_2$. In that case it is preferable to realize the required compensation voltage $V_{CMP}$ not with only one voltage follower VF but with a cascade of a plurality of voltage followers VF. FIG. 4 by way of example shows four cascaded voltage followers VF in order to realize the required compensation voltage $V_{CMP}$.

Figure 6:
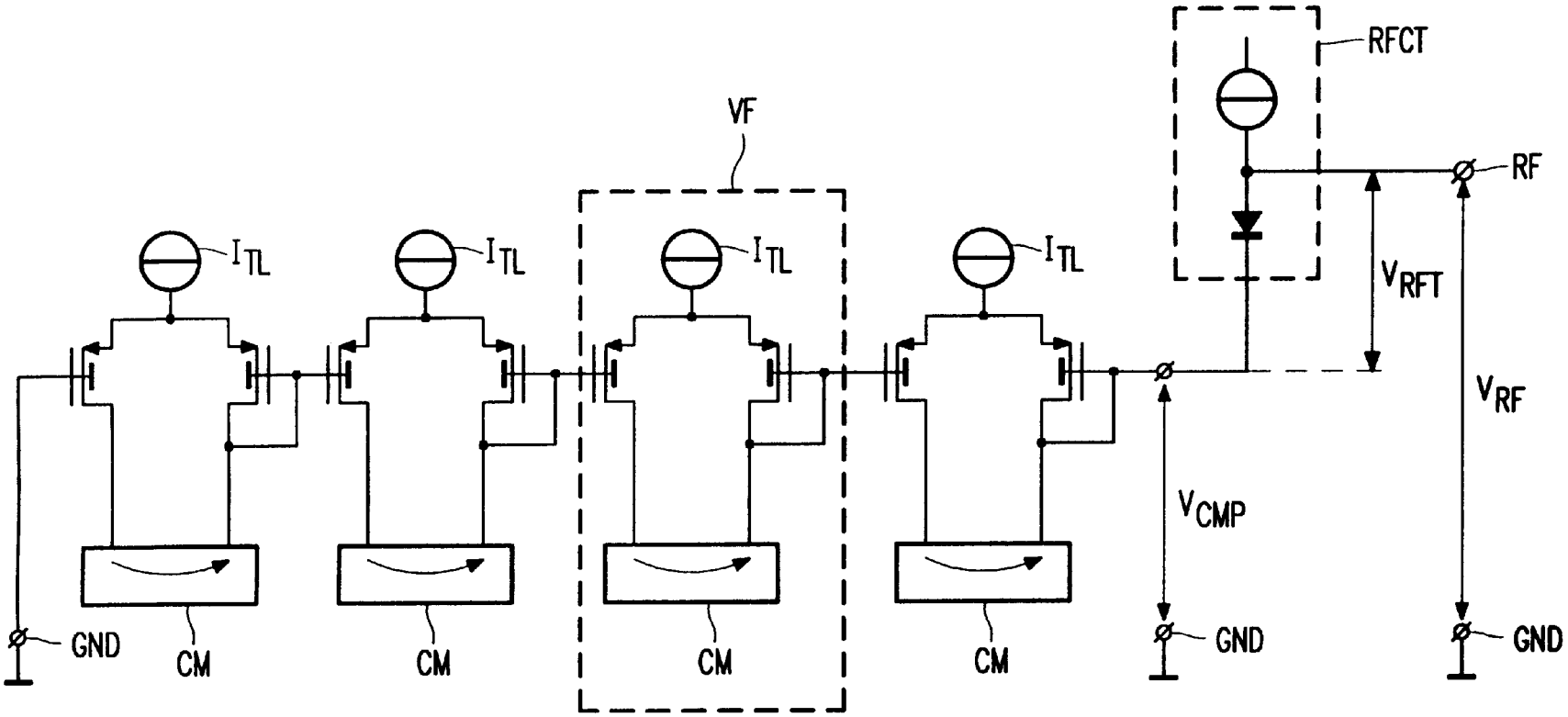
FIG. 6 shows a third embodiment of a reference voltage source in accordance with the invention.

FIG. 5 shows a second embodiment of a reference voltage source RFS in accordance with the invention. A relevant difference with the first embodiment as shown in FIG. 4 is that a buffer BF is arranged between the reference circuit RFCT and the input IN of the voltage follower VF for buffering the reference voltage $V_{RFT}$. This may be necessary if the input IN of the voltage follower VF does not have a sufficiently high impedance, which would adversely affect the reference voltage $V_{RFT}$. This can be the case, for example, when bipolar transistors or DTMOSTs are used for the first transistor $T_1$ and the second transistor $T_2$. FIG. 6 shows a third embodiment of a reference voltage source RFS in accordance with the invention.

A relevant difference with the first and the second embodiment as shown in FIGS. 4 and 5 is that in the series arrangement of the reference circuit RFCT and the voltage followers VF their positions have been interchanged. As a result of this, the voltage on the tail TL of the differential pair DF is lower, which has the advantage that voltage which is potentially available across the tail current source $I_{TL}$ is higher. This enables the reference voltage source RFS to be operated at a lower supply voltage. It is to be noted that the current which flows through the reference circuit RFCT influences the setting of the right-most voltage follower VF in FIG. 6. However, this need not adversely affect the operation of the reference voltage source RFS. It does require, however, an adaptation of the dimensioning of the relevant voltage follower VF.

Figure 7:
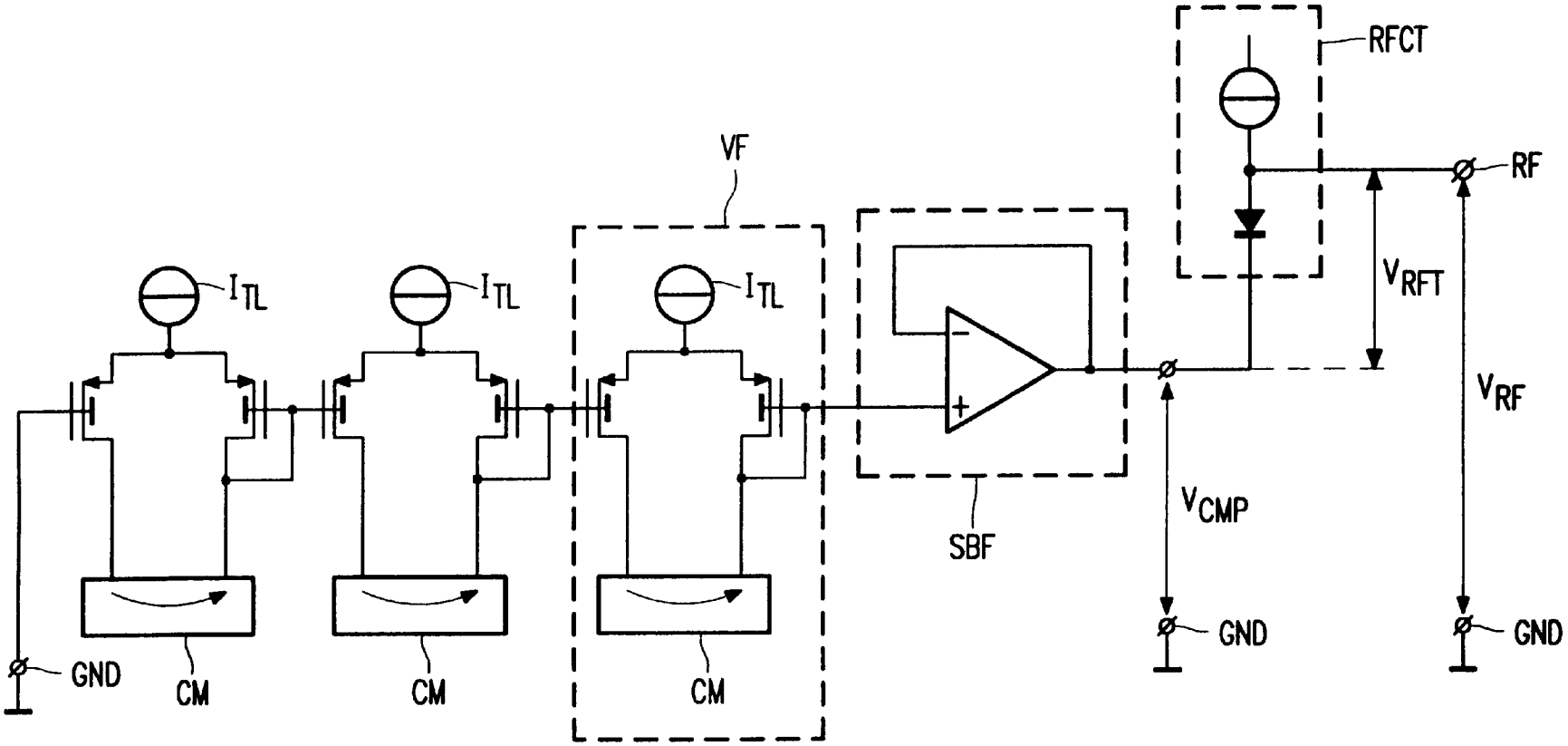
FIG. 7 shows a fourth embodiment of a reference voltage source in accordance with the invention.

FIG. 7 shows a fourth embodiment of a reference voltage source RFS in accordance with the invention. In order to prevent the current which flows through the reference circuit RFCT from influencing the voltage follower VF (as is the case in the embodiment shown in FIG. 6), which would complicate the dimensioning of the relevant voltage follower VF, an isolation buffer WSBF can be arranged between the right-most voltage follower VF and the reference circuit RFCT. The current through the reference circuit RFCT then flows through an output of the isolation buffer SBF.

Instead of the P-type transistors shown in the Figures it is also possible to use N-type transistors. The current mirror CM can be constructed by means of bipolar transistor but also by means of field effect transistors. The reference voltage source RFS can be implemented in an integrated circuit but also by means of discrete components.

I claim:

1. A reference voltage source for supplying a compensated reference voltage the reference voltage source comprising: a reference circuit supplying a reference voltage with a negative linear temperature coefficient; and a voltage follower having at least one differential pair coupled to the reference voltage source to supply a compensation voltage in series with the reference voltage, said compensation voltage having a positive linear temperature coefficient at least substantially opposite the negative linear temperature coefficient in order to obtain a temperature compensated output reference voltage ($V_{RF}$).

2. A reference voltage source as claimed in claim 1, characterized in that the at least one differential pair comprises two transistors which have not been matched with one another.

3. A reference voltage source as claimed in claim 2, characterized in that the two transistors exhibit an exponential voltage-current characteristic.

4. A reference voltage source as claimed in claim 3, characterized in that the two transistors are formed by field effect transistors operated in their weak inversion region.

5. A reference voltage source as claimed in claim 3, characterized in that the two transistors are formed by field effect transistors having backgates coupled to gates of the respective field effect transistors.

6. A reference voltage source as claimed in claim 3, characterized in that the two transistors are formed by bipolar transistors.

7. A reference voltage source according to claim 1, wherein said voltage follower includes a plurality of said differential pairs coupled in cascade.

8. A reference voltage source according to claim 7, wherein said voltage follower includes a buffer between said reference circuit and said voltage follower.

9. A reference voltage source according to claim 1, wherein said reference circuit is coupled to an output of said voltage follower.

10. A reference voltage source according to claim 9, further comprising an isolation buffer coupled between said output of said voltage follower and the reference circuit.

* * * * *